US009746188B2

(12) United States Patent
Worrell

(10) Patent No.: US 9,746,188 B2
(45) Date of Patent: Aug. 29, 2017

(54) RECIRCULATING DOWNDRAFT SYSTEM FOR A COOKING APPLIANCE

(71) Applicant: Electrolux Home Products, Inc., Charlotte, NC (US)

(72) Inventor: John Worrell, Gallatin, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 470 days.

(21) Appl. No.: 14/227,039

(22) Filed: Mar. 27, 2014

(65) Prior Publication Data

US 2014/0290641 A1 Oct. 2, 2014

Related U.S. Application Data

(60) Provisional application No. 61/805,690, filed on Mar. 27, 2013, provisional application No. 61/877,056, filed on Sep. 12, 2013, provisional application No. 61/884,437, filed on Sep. 30, 2013, provisional application No. 61/884,428, filed on Sep. 30, 2013, provisional application No. 61/884,422, filed on Sep. 30, 2013, provisional application No. 61/896,165, filed on Oct. 28, 2013, provisional application No. 61/896,721, filed on Oct. 29, 2013.

(51) Int. Cl.
*F24C 15/20* (2006.01)

(52) U.S. Cl.
CPC ..... *F24C 15/2042* (2013.01); *F24C 15/2078* (2013.01)

(58) Field of Classification Search
CPC ..... F24C 15/2042; F24C 15/2064
USPC ..... 126/273 R, 198, 299 D
See application file for complete search history.

(56) References Cited

U.S. PATENT DOCUMENTS

| | | | | |
|---|---|---|---|---|
| 468,964 A | | 2/1892 | Cockrell | |
| 607,976 A | | 7/1898 | Amos | |
| 913,465 A | | 2/1909 | Brouillet | |
| 2,582,884 A | | 1/1952 | Nicol | |
| 2,674,991 A | | 4/1954 | Schaefer | |
| 3,766,906 A | * | 10/1973 | Jenn | F24C 15/2042 126/299 R |
| 4,034,663 A | | 7/1977 | Jenn et al. | |

(Continued)

FOREIGN PATENT DOCUMENTS

| | | |
|---|---|---|
| DE | 3708900 A1 | 9/1988 |
| GB | 2126334 A | 3/1984 |

(Continued)

*Primary Examiner* — Avinash Savani
(74) *Attorney, Agent, or Firm* — Pearne & Gordon, LLP

(57) ABSTRACT

Provided is a cooking appliance that includes an oven cavity and an oven door pivotally mounted to a front surface and configured to selectively provide access to an interior of the oven cavity. A cooktop includes a heating element and an inlet of a downdraft system exposed at a top surface of the cooking appliance. An outlet is provided through which air drawn into the downdraft system through the inlet is exhausted to an ambient environment of a room in which the cooking appliance is located. An air duct system conveys air between the inlet and the outlet, and a blower draws air from the ambient environment of the cooking appliance adjacent to the cooktop into the inlet and through the air duct system to be expelled through the outlet back into the ambient environment.

8 Claims, 8 Drawing Sheets

(56) References Cited

U.S. PATENT DOCUMENTS

| | | | | |
|---|---|---|---|---|
| 4,083,361 | A | 4/1978 | Bergmark et al. | |
| 4,411,254 | A | 10/1983 | Field et al. | |
| 4,428,357 | A | 1/1984 | Field | |
| 4,527,542 | A | 7/1985 | Bales et al. | |
| 4,562,827 | A | 1/1986 | Cerola | |
| 4,766,880 | A | 8/1988 | Von Blanquet | |
| 4,899,028 | A | 2/1990 | Arai et al. | |
| 4,934,337 | A | 6/1990 | Falk | |
| 5,000,160 | A | 3/1991 | Dunlop et al. | |
| D327,538 | S | 6/1992 | Falk et al. | |
| 5,119,802 | A | 6/1992 | Cherry et al. | |
| 5,193,520 | A * | 3/1993 | Gostelow | F24C 15/006 126/198 |
| 5,209,217 | A | 5/1993 | Beach et al. | |
| 5,279,279 | A | 1/1994 | White | |
| 5,884,619 | A | 3/1999 | Terry | |
| 6,172,338 | B1 | 1/2001 | Barnes | |
| 6,234,161 | B1 * | 5/2001 | Levi | F24C 15/006 126/19 R |
| 6,293,276 | B1 | 9/2001 | Owens et al. | |
| 6,455,818 | B1 | 9/2002 | Arntz et al. | |
| 6,575,157 | B1 | 6/2003 | Shaver | |
| 6,732,729 | B2 | 5/2004 | Yeung | |
| 6,732,730 | B1 | 5/2004 | Lin | |
| 6,895,955 | B2 | 5/2005 | Glassi | |
| 7,687,748 | B2 | 3/2010 | Gagas | |
| 7,836,877 | B2 | 11/2010 | Gagas et al. | |
| 8,028,619 | B2 | 10/2011 | Lee et al. | |
| 8,122,877 | B2 | 2/2012 | Baumann et al. | |
| 8,312,873 | B2 | 11/2012 | Gagas et al. | |
| 8,375,849 | B2 | 2/2013 | Sajjad et al. | |
| 8,445,821 | B2 | 5/2013 | Iwamoto | |
| 2007/0062513 | A1 | 3/2007 | Gagas | |
| 2010/0012110 | A1 | 1/2010 | Feisthammel et al. | |
| 2010/0051010 | A1 | 3/2010 | Colburn et al. | |
| 2010/0059040 | A1 | 3/2010 | Shaffer et al. | |
| 2010/0147159 | A1 | 6/2010 | Fossati | |
| 2011/0146657 | A1 | 6/2011 | Briedis et al. | |
| 2011/0168153 | A1 | 7/2011 | Purinton et al. | |
| 2012/0125316 | A1 | 5/2012 | Saraf et al. | |
| 2013/0008429 | A1 | 1/2013 | Colburn et al. | |

FOREIGN PATENT DOCUMENTS

| | | | |
|---|---|---|---|
| GB | 2147990 | A | 5/1985 |
| JP | S63150528 | A | 6/1988 |
| JP | S63150533 | A | 6/1988 |
| JP | H0560355 | A | 3/1993 |

* cited by examiner

FIG. 5
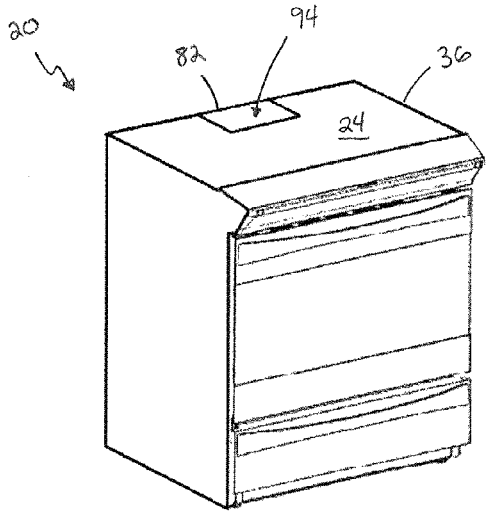
FIG. 6
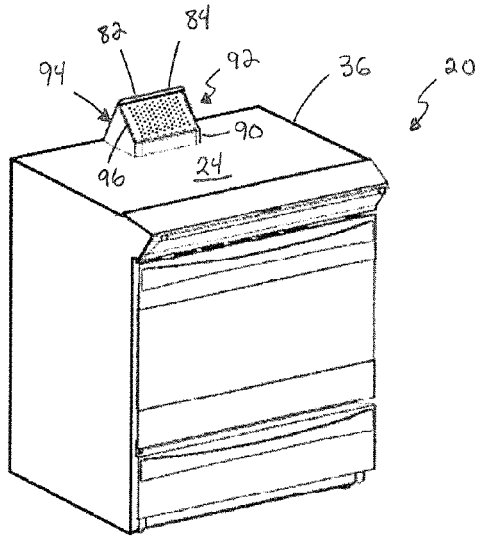
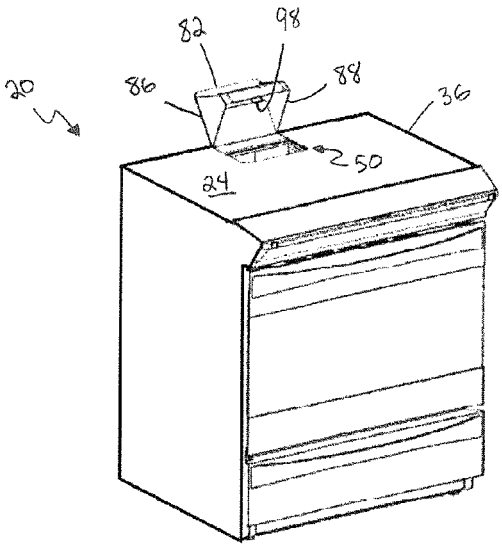
FIG. 7
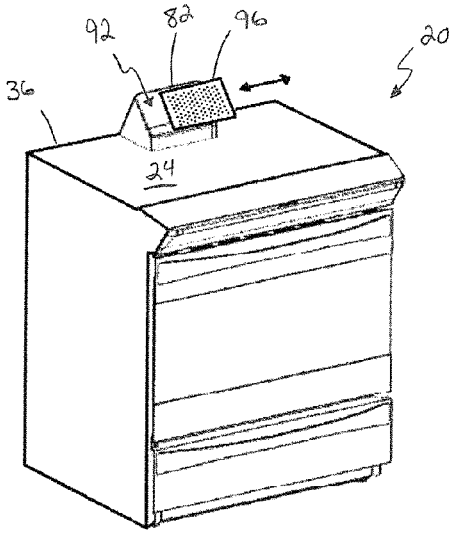
FIG. 8

RECIRCULATING DOWNDRAFT SYSTEM FOR A COOKING APPLIANCE

CROSS-REFERENCE TO RELATED APPLICATIONS

This application claims the benefit of U.S. Provisional Application No. 61/805,690, filed Mar. 27, 2013; U.S. Provisional Application No. 61/877,056, filed Sep. 12, 2013; U.S. Provisional Application No. 61/884,437, filed Sep. 30, 2013; U.S. Provisional Application No. 61/884,428, filed Sep. 30, 2013; U.S. Provisional Application No. 61/884,422, filed Sep. 30, 2013; U.S. Provisional Application No. 61/896,165, filed Oct. 28, 2013; and U.S. Provisional Application No. 61/896,721, filed Oct. 29, 2013; each of which is incorporated in its entirety herein by reference.

TECHNICAL FIELD

This application relates generally to a cooking appliance and, more specifically, to a cooking appliance comprising a recirculating downdraft system.

BACKGROUND

When using open top vessels on the surface heating elements of a cooking appliance, vapors are given off in large quantities. Certain components of these vapors emit an unpleasant smell and other components, particularly the grease components, are highly objectionable. In the absence of some means for removing such components, an unpleasant aroma can permeate the cooking environment and grease can become deposited upon the kitchen walls or other surfaces near the appliance. If not cleaned frequently, the surfaces can become quite filthy.

Ventilation systems may be provided that suck air from above a cooking surface of a cooking appliance and expel the air into another room or the outside. However, these systems can require the installation of duct work through the walls of the kitchen and other components that are external to the cooking appliance. Moreover, particularly with apartments, extensive duct work may be necessary to reach another environment for the air to be expelled into.

SUMMARY

Therefore, there is a need for a ventilation system that can clean the air and recirculate the air back into the kitchen without the need for such duct work. Moreover, there is a need for a ventilation system that can be provided entirely within the cooking appliance such that the air may be cleaned and recirculated without requiring the installation of other external components.

According to one aspect, the present technology is directed toward a cooking appliance that includes an oven cavity and an oven door pivotally mounted to a front surface and configured to selectively provide access to an interior of the oven cavity. A cooktop includes a heating element and an inlet of a downdraft system exposed at a top surface of the cooking appliance. An outlet is provided through which air drawn into the downdraft system through the inlet is exhausted to an ambient environment of a room in which the cooking appliance is located. An air duct system conveys air between the inlet and the outlet, and a blower draws air from the ambient environment of the cooking appliance adjacent to the cooktop into the inlet and through the air duct system to be expelled through the outlet back into the ambient environment.

According to another aspect, the present technology is directed toward a cooking appliance having a top surface, bottom surface, front surface, back surface, a first side surface, and a second side surface opposing the first side surface. The cooking appliance includes an oven cavity, and an oven door pivotally coupled to the front surface and configured to selectively provide access to the oven cavity. A cooktop defines the top surface of the cooking appliance includes at least one heating element and an inlet. A first outlet and a second outlet are provided to exhaust air to different exhaust locations. An air duct system is configured to selectively provide air communication between the inlet and the first outlet and further configured to selectively provide air communication between the inlet and the second outlet. A blower is configured to selectively draw air from an ambient environment of the cooking appliance into the inlet and through the air duct system and expel the air out the first outlet back into the ambient environment. The blower is adjustable to selectively draw the air from the ambient environment of the cooking appliance into the inlet and through the air duct system and expel the air out the second outlet.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

These and other aspects are better understood when the following detailed description is read with reference to the accompanying drawings, in which:

FIG. 5 is a perspective view of the example cooking appliance showing an access member of the cooking appliance in a first position;

FIG. 6 is a perspective view of the example cooking appliance showing the access member in a second position;

FIG. 7 is a perspective view of the example cooking appliance showing the access member in a third position;

FIG. 8 is a perspective view of the example cooking appliance showing the sliding engagement of an inlet filter of the cooking appliance with the access member;

DETAILED DESCRIPTION

Figure 1:
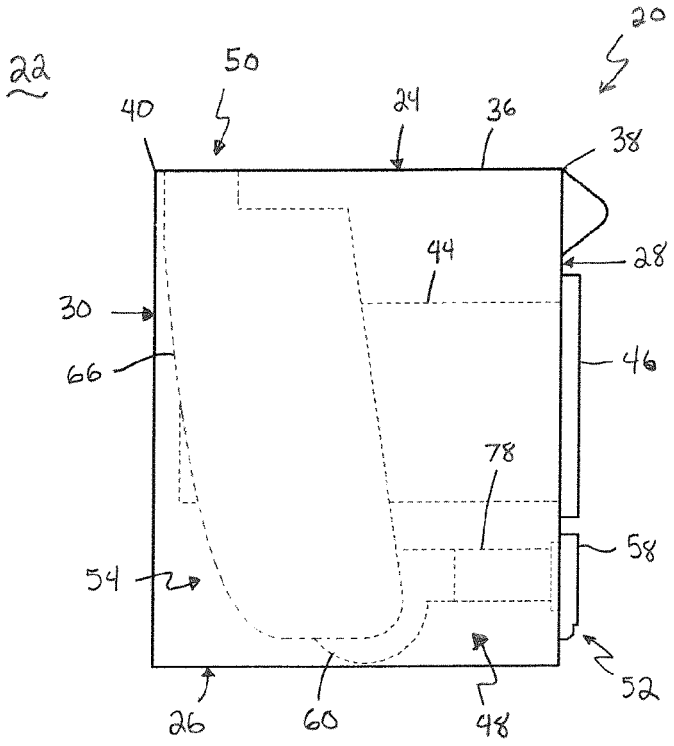
FIG. 1 is a side view of an illustrative embodiment of a cooking appliance.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Figure 2:
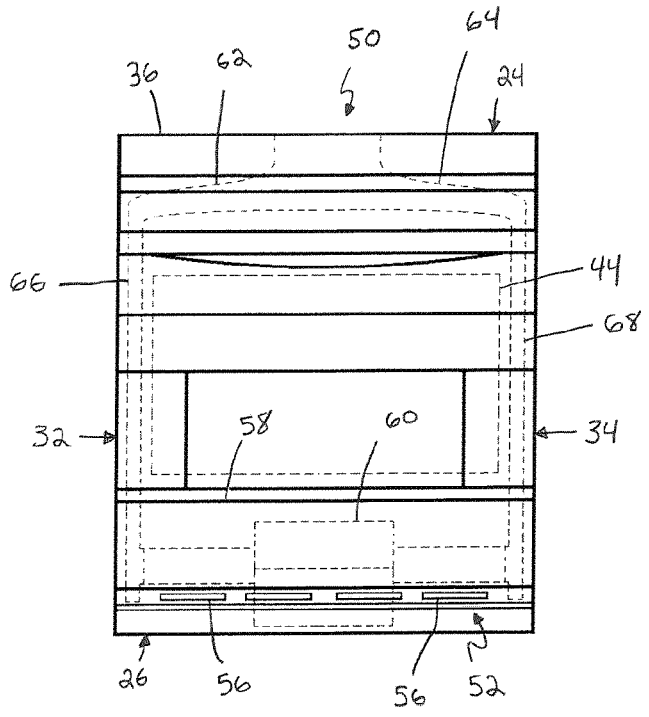
FIG. 2 is a front view of the example cooking appliance.
Figure 3:
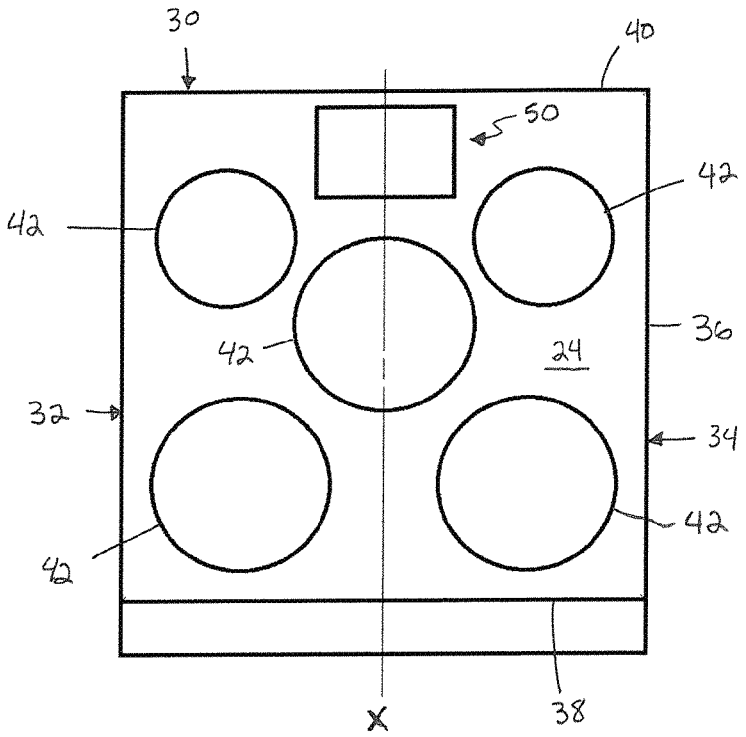
FIG. 3 is a top view of the example cooking appliance.

Referring now to FIGS. 1-3, an example cooking appliance 20 is shown that is located in an interior area 22 such as a kitchen. The interior area 22 may be part of an enclosed space such as a residential building, a commercial building or the like. The cooking appliance 20 may be removably mounted with respect to the interior area 22 and may be described as a range, a stove, a cooker, a home or kitchen appliance, or the like. The cooking appliance 20 may be substantially box-shaped so as to include a top surface 24, bottom surface 26, front surface 28, back surface 30, a first side surface 32, and a second side surface 34 opposing the first side surface 32.

The cooking appliance 20 includes a cooktop 36 which substantially defines the top surface 24 and has a front edge 38 at the front of the cooking appliance 20 and a rear edge 40 at the back of the cooking appliance 20. The top surface 24 of the cooktop 36 can optionally include a glass panel that overlays electric and/or inductive embodiments of the heating elements 42. The cooktop 36 can optionally have a thirty (30 in.) inch width, a 36 inch width, or any other desired dimension. Additionally, the cooktop 36 includes at least one heating element 42 on which a cooking vessel may be placed to be heated. The cooktop 36 in the present example comprises a total number of five heating elements 42. However, the cooktop 36 may comprise any number of heating elements without departing from the scope of the invention. When comprising a plurality of heating elements 42, the heating elements 42 can optionally be equal in diameter or the heating elements 42 may vary in diameter, as illustrated in the provided example.

The cooking appliance 20 further includes an oven cavity 44 and an oven door 46 which is pivotally mounted to the front surface 28 and configured to selectively provide access to the oven cavity 44. The oven door 46 can pivot between a closed position and an open position. At the closed position, the oven door 46 partially covers the front surface 28. Meanwhile, at the open position, the oven door 46 provides access to the oven cavity 44.

The cooking appliance 20 includes a recirculating downdraft system 48 which provides ventilation for the interior area 22 forming the ambient environment of the cooking appliance 20 by removing impurities in smoke, fumes, odors or the like that are generated near the cooking appliance 20 and especially above the cooktop 36. The recirculating downdraft system 48 includes an inlet 50, an outlet 52, and an air duct system 54 configured to provide air communication between the inlet 50 and the outlet 52 such that the odors, fumes or the like can be channeled through the recirculating downdraft system 48 from the inlet 50 to the outlet 52. The outlet 52 in the present example comprises a plurality of apertures 56 defined by an auxiliary door 58 of the cooking appliance 20. However, it should be appreciated that the outlet 52 may comprise a single aperture. Moreover, the outlet 52 may be defined by another portion of the cooking appliance 20. For example, the outlet 52 may be defined by the back surface 30, the first side surface 32, or the second side surface 34. Preferably, the outlet 52 is positioned below the oven cavity 44. However, the outlet 52 may be positioned above the oven cavity 44 in other embodiments.

The inlet 50 may be defined by the cooktop 36. Preferably, the inlet 50 is arranged at a rear portion of the cooktop 36 along a centerline X of the cooktop 36, though it is understood that the inlet 50 can be offset from the centerline X or positioned in portions of the cooktop 36 closer to the front. As shown in FIG. 3, the inlet 50 of the example cooking appliance 20 is arranged adjacent the rear edge 40 such that the total number of heating elements 42 are each located at least partially between the inlet 50 and the front edge 38. According to alternate embodiments, a rearward-most edge of the inlet 50 is defined by the rear edge 40 of the cooktop 36. Additionally, the heating elements 42 are arranged such that at least one of the heating elements 42 is positioned along, optionally centrally positioned along, the centerline X of the cooktop 36 directly in front of the inlet 50. According to an embodiment that includes a heating element 42 at an high-intensity downdraft location as shown in FIG. 3, at least one heating element 42 can be centrally located along the centerline X of the cooktop 36, immediately forward of the inlet 50, which can also optionally be centrally positioned along the centerline X. During operation of the downdraft system 48 as described herein, smoke, fumes, odors and the like emitted from a cooking vessel on the heating element 42 in the high-intensity zone are subjected to a greater vacuum effect generated through operation of the blower 60 than that emitted from a cooking vessel being heated by another heating element 42 located elsewhere on the cooktop 36. Accordingly, particularly odorous foods can be heated by the heating element 42 in the high-intensity zone to maximize the smoke, fumes, odors etc. . . . drawn in by the downdraft system 48.

The cooking appliance 20 further comprises a blower 60 configured to draw air from an ambient environment of the cooking appliance 20 (e.g. the interior area 22) into the inlet 50 and through the air duct system 54 and expel the air out the outlet 52 back into the ambient environment. The blower 60 when operated establishes a vacuum effect at the inlet 50 that draws odors, fumes or the like above the cooktop 36 into the air duct system 54. The blower 60 is a centrifugal fan in the present example. However, other types of blowers (e.g., axial) may also be used to draw odors, fumes or the like above the cooktop 36 from the inlet 50 to the outlet 52 through the air ducts system 54.

Figure 4:
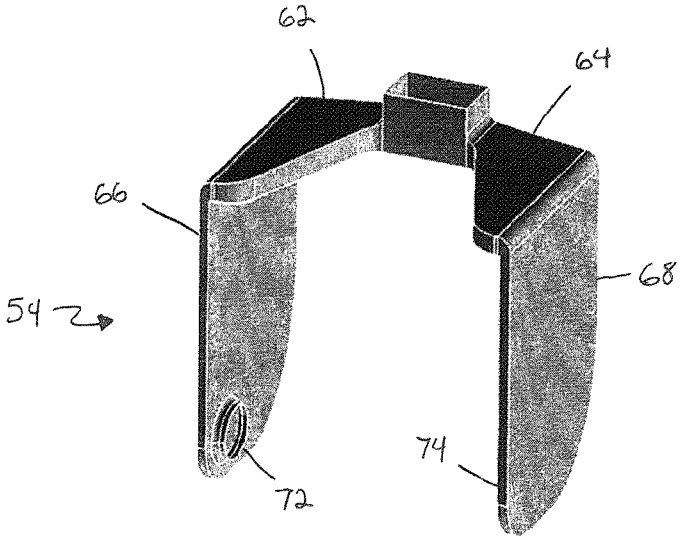
FIG. 4 is a perspective view of a plurality of plenums within the example cooking appliance.

It is generally desired to maintain the oven cavity 44 at a central location on the cooking appliance 20 to increase convenience for the user, and also to increase, such as maximize, the usable size of the oven cavity 44. Additionally, it is generally desired to optimize airflow within the air duct system 54 from the inlet 50 to the outlet 52. Thus, the air duct system 54 of the example cooking appliance 20 comprises a symmetrical arrangement of plenums running along both side surfaces 32, 34 of the cooking appliance 20 so as to surround the oven cavity 44. The arrangement of plenums can be viewed in phantom in FIGS. 1 & 2. Additionally, FIG. 4 offers a perspective view of the plenums without showing the surrounding structure of the cooking appliance 20. It is understood that while a symmetrical arrangement of plenums is shown in the figures and described below, the plenums may not be exactly symmetrical but at least mostly, such as substantially, symmetrical so as to accommodate various internal geometries or features of the cooking appliance 20.

The air duct system 54 generally comprises a first inlet plenum 62 and a second inlet plenum 64 that are symmetrically arranged about the inlet 50. Each of the first and second plenums 62, 64 are then connected to first and second side plenums 66, 68, respectively, that extend vertically downwards along the side surfaces 32, 34 of the cooking appliance 20. The first and second side plenums 66, 68 are each adjacent the exterior side walls of the cooking appliance 20, and generally capture the oven cavity 44 therebetween. The first side plenum 66 extends along the first side surface 32 in between the first side surface 32 and the oven cavity 44. Meanwhile, the second side plenum 68 extends along the second side surface 34 in between the second side surface 34 and the oven cavity 44.

Each of the side plenums 66, 68 includes a plenum outlet 72, 74 located under the oven cavity 44 that is in air communication with the blower 60 located at the bottom of the cooking appliance 20. The plenum outlets 72, 74 can be directly connected to the blower 60, such as via hard ducting and/or flexible hoses, or alternatively the plenum outlets 72, 74 can exhaust into a chamber located at the bottom of the cooking appliance 20 that is in fluid communication with the blower 60. Regardless of the connection, each of the plenum outlets 72, 74 is coupled to an inlet formed on opposite lateral sides of the blower 60. The blower 60 then exhausts the air to the outlet 52 of the cooking appliance 20 through an outlet plenum 78. It should be appreciated that although the blower 60 in the present embodiment is located at the bottom of the cooking appliance 20 and downstream of the plenums 62, 64, 66, 68, other locations for the blower 60 are possible. For example, the blower may be located near the top of the cooking appliance 20 and upstream of the plenums 62, 64, 66, 68.

The configuration of the air duct system 54 described above provides a first and second air path for air to flow between the inlet 50 and the outlet 52. The first air path directs air from the inlet 50 through the first inlet plenum 62 and the first side plenum 66 to the blower 60, which exhausts the air to the outlet 52 via the outlet plenum 78. Meanwhile, the second air path directs air from the inlet 50 through the second inlet plenum 64 and the second side plenum 68 to the blower 60, which exhausts the air to the outlet 52 via the outlet plenum 78. The various plenums of the air duct system 54 are designed to provide a relatively consistent cross-sectional area for the flow of air passing therethrough. For example, the cross-sectional area of the inlet 50 can be approximately forty (40 $in^2$) square inches (although various other sizes are contemplated). The cross-sectional areas of each of the first and second inlet plenums 62, 64 and the first and second side plenums 66, 68 can be roughly half of the cross-sectional area of the inlet 50, or approximately twenty (20 $in^2$) square inches each. The geometry of each plenum can be designed to provide the 20 square inches and also accommodate for other various internal geometries or features of the cooking appliance 20. For example, each of the first and second side plenums 66, 68 can have a width, when viewed from the side, that is approximately 20 inches. By having a width that is approximately 20 inches, the first and second side plenums 66, 68 can have a relatively smaller thickness of approximately one (1 in.) inch, which can help to maximize the distance spanned by the oven cavity 44 between laterally-disposed side surfaces 32, 34. Additionally, so as to accommodate the changing geometry between the inlet 50 and the first and second side plenums 66, 68, each of the first and second inlet plenums 62, 64 can taper vertically towards a reduced cross-sectional area while at the same time increasing horizontally towards an increased cross-sectional area to match the width of the first and second side plenums 66, 68. It is generally preferred that the transitions between the various elements of the air duct system 54 are relatively smooth and gradual, such as by using gradual tapers and curved corners, to inhibit airflow restrictions and reduce noise that would otherwise be generated by air flowing through orthogonal transitions. It is also contemplated that various deflectors, louvers, diffusers, etc. could be used to redirect, equalize, or otherwise modify the airflow passing through the air duct system 54.

Figure 18:
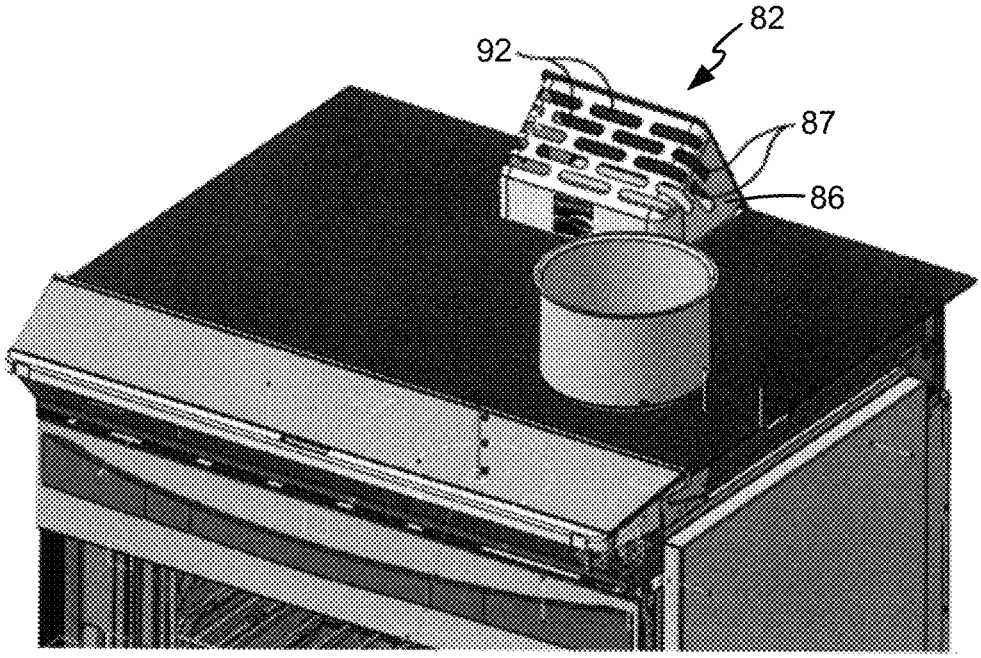
FIG. 18 is a perspective view of an alternate embodiment of an access member including an aperture formed in a side wall.

Turning to FIGS. 5-8, the cooking appliance 20 may include an access member 82 pivotally coupled to the cooktop 36. The access member 82 comprises a cover panel 84, a pair of opposed side walls 86, 88, and a front wall 90 which define an opening 92. The access member 82 can pivot about a hinge point between a first position (shown in FIG. 5), a second position (shown in FIG. 6), and a third position (shown in FIG. 7). At the first position, a cover surface 94 of the cover panel 84 is flush with the top surface 24 (e.g., the cover panel 84 is formed as a glass panel that is flush with the glass panel of the top surface 24) and conceals the inlet 50 from above, thus prohibiting air, grease, food, and other debris from entering the downdraft system 48. At the second position, the access member 82 is configured to permit air to enter the inlet 50. Specifically, air can pass through the opening 92 of the access member 82 and into the inlet 50. An inlet filter 96 may be provided to permit air entrained with smoke, fumes, odor, etc. . . . to enter the opening 92 leading to the inlet 50 but capture grease, food or other debris, also entrained in the air, thus preventing such items from passing through the opening 92 and entering the downdraft system 48. Although the access member 82 shown in FIGS. 5-8 comprises side walls 86, 88 without apertures, it should be appreciated that in other embodiments, the side walls 86, 88, as shown in FIG. 18 for example, may each comprise one or more apertures 87 that also permit air to pass therethrough and enter the inlet 50 when the access member 82 is in the second position. The embodiment of the openings 92 and side apertures 87 shown in FIG. 7 are generally oval or cylindrically shaped, the openings 92 and optional side apertures 87 can independently designed with any desired shape suitable for allowing air to enter the downdraft system 48, yet at least partially filter debris entrained in the air such as grease, food, etc. . . . . Moreover, the access member 82 in other embodiments may comprise a wall with apertures in place of the opening 92 that permits air to pass therethrough and enter the inlet 50 when the access member 82 is in the second position. The access member 82 may take on a variety of forms that permit air to enter the inlet 50 in a second position without departing from the scope of the invention.

When pivoted to the second position, the cover surface 94 of the example access member 82 extends over the inlet 50 at an acute angle (e.g., between 10° and 90°, opening forward) relative to the top surface 24, thus blocking air that is behind or directly above the cover surface 94 from entering the inlet 50. Moreover, the opening 92 of the access member 82 is elevated relative to the cooktop 36 and faces the front of the cooking appliance 20. This configuration provides a variety of benefits. Smoke, fumes, and odors from cooking typically emanate from pots and pans that are in front of the inlet 50 and elevated with respect to the cooktop 36. Thus, the elevated opening 92 improves the downdraft system's ability to capture air in elevated areas that are more likely to contain undesirables. Additionally, flames or other forms of heat from the cooktop heating elements 42 that are below the elevated opening 92 are less affected by the vacuum force that is present at the opening 92 since it is elevated. As such, more heat is advantageously transferred from the heating elements 42 to the cooking vessels resting thereon. Moreover, the angled cover surface 94 focuses vacuum effect towards areas in front of the access member 82 rather than areas behind or directly above the access member 82, which are less likely to contain undesirable fumes, smoke, odors, etc. . . . . Thus, the configuration of the example access member 82 has an improved ability to capture smoke, fumes, and odors from cooking while reducing its impact on heat transfer between the heating elements 42 and cooking vessels.

When pivoted to the third position, the access member 82 is configured to provide access to the interior of the air duct system 54, and optionally inlet 50, for cleaning, servicing, replacing filters, or performing other various operations. For example, the cover surface 94 can be pivoted to an angle greater than 90° relative to the top surface 24, as shown in FIG. 7, to expose the inlet 50. Specifically, the access member 82 is rotated beyond the second position such that passage through the opening 92 is no longer required to enter the inlet 50. In this manner, access to the air duct system 54 is made easier.

In some instances, it may be desirable to prevent movement of the access member 82 between positions. As such, the access member 82 can comprise a catch member 98 that cooperates with a portion of the cooktop 36 or other structure of the cooking appliance 20 to releasably secure the access member 82 in the second position. When engaged with the cooktop 36, the catch member 98 can lock the access member 82 in the second position, thus preventing rotation of the access member 82 to the first position or the second position or both. The catch member 98 can be manipulated to selectively release the access member 82, allowing it to pivot or otherwise be adjusted.

As illustrated in FIG. 8, the inlet filter 96 is slidably engaged with the access member 82 such that the inlet filter 96 can be optionally removed or installed by hand without the use of tools. The inlet filter 96 can be repeatedly removed and replaced with a new inlet filter 96, or the same inlet filter 96 that was previously removed and cleaned. To slidably install or remove the inlet filter 96 in the present example, the inlet filter 96 can be slid horizontally along a track of the access member 82. This horizontal motion allows the access member 82 to rotate between the first and second position without risk of the inlet filter 96 falling out do to contact with a portion of the cooktop 36 or other object provided to the cooking appliance 20 according to such embodiments. It should be appreciated however that other sliding motions (e.g. vertical) may be used in other embodiments to install and/or remove the inlet filter 96. Indeed, the inlet filter 96 can optionally be installed using any sort of fastening means, even ones that do not involve a sliding engagement according to other embodiments. Moreover, the inlet filter 96 may be coupled to other members besides the access member 82. For example, the inlet filter 96 may be provided within the inlet 50 or any other portion of downdraft system 48. Preferably, the inlet filter 96 is provided upstream of the blower 60 to prevent grease, food or other debris from entering the blower 60.

Figure 11:
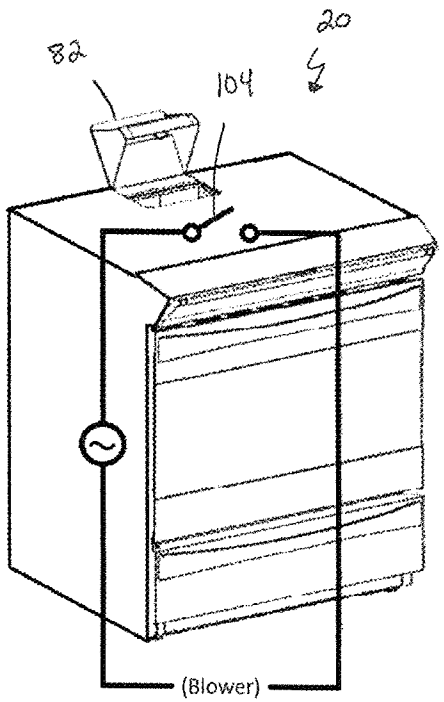
FIG. 11 is a schematic view of the power supply circuit when the access member is in the third position.
Figure 10:
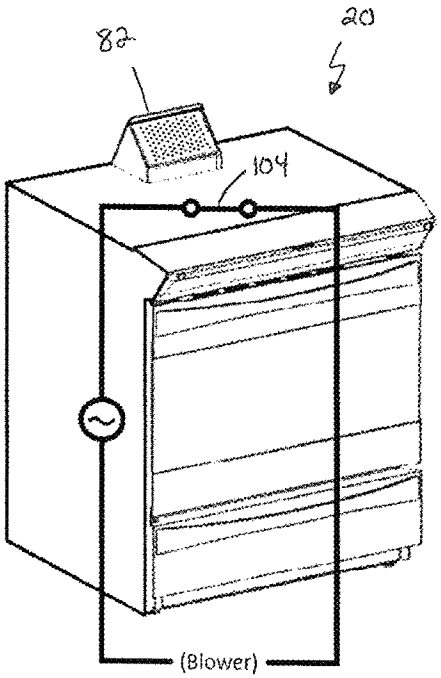
FIG. 10 is a schematic view of the power supply circuit when the access member is in the second position.
Figure 9:
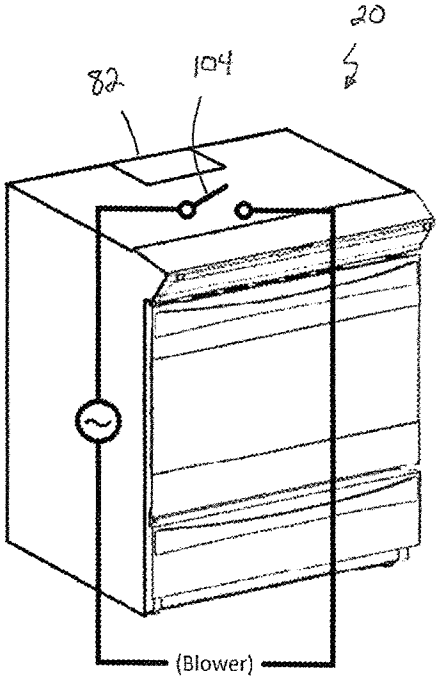
FIG. 9 is a schematic view of a power supply circuit for the example cooking appliance when the access member is in the first position.

Depending on the position of the access member 82, it may be desired to prevent operation of the blower 60. For example, when the access member 82 is in the first position, the inlet 50 is concealed and the close tolerance between the opening 92 and the cooktop 36 or other portion of the cooking appliance 20 interferes with the entry of the air into the downdraft system 48 through the inlet 50. As such, operation of the blower 60 with the access member 82 in the first position may strain the blower 60, and should be avoided. As another example, when the access member 82 is in the third position, it may be desired to prevent operation of the blower 60 so that cleaning, servicing, or other operations may be performed within the air duct system 54 or other portion of the downdraft system 48 without the risk or disturbance caused by operation of the blower 60 at this time. Thus, as shown in FIGS. 9-11, the cooking appliance 20 may comprise a first switch 104 configured to prevent operation of the blower 60 while the access member 82 is in the first position or any other position and/or orientation other than the second position. For example, when the access member 82 is in the first position (as shown in FIG. 9) or the third position (as shown in FIG. 11), the first switch 104 is open and thus interrupts a power supply circuit for the blower 60. Meanwhile, when the access member 82 is in the second position (as shown in FIG. 10), the first switch 104 is closed and thus closes the power supply circuit for the blower 60. The first switch 104 may be a proofing switch, for example, or other appropriate device that can interfere with operation of the blower 60 while the access member 82 is not in the second position. Moreover, although the first switch 104 in the example cooking appliance 20 is directly tied into the power supply circuit for the blower 60, the first switch 104 in other embodiments can be indirectly connected, such as through an interposing relay. The first switch 104 can also provide a signal to a controller for the cooking appliance 20, which in turn controls the operation of the blower 60 based on the state of the first switch 104.

Figure 14:
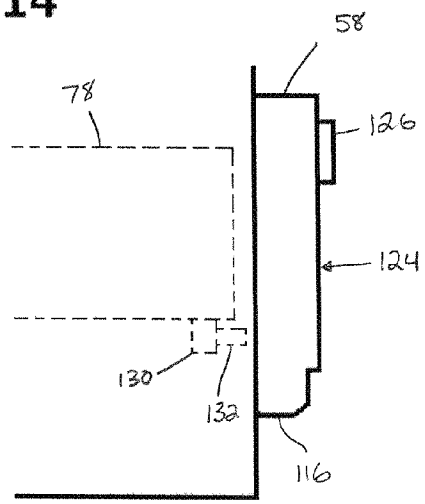
FIG. 14 is a side view of an auxiliary door when the auxiliary door is in the first position and the air filter is not attached to the auxiliary door.
Figure 13:
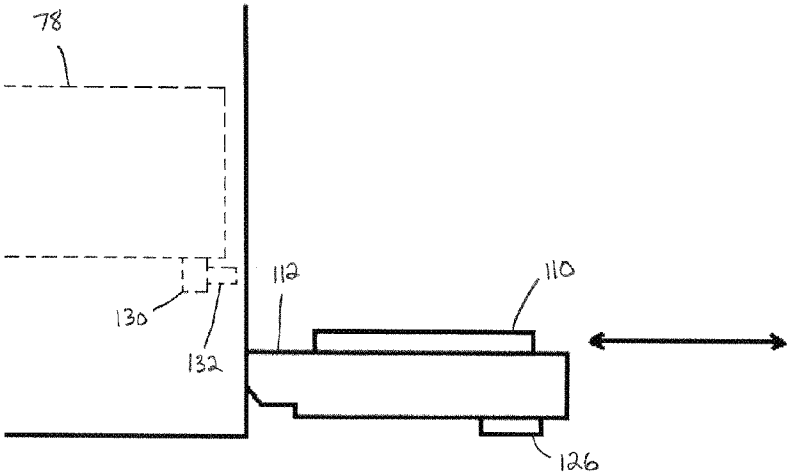
FIG. 13 is a side view of an auxiliary door when the auxiliary door is in a second position.
Figure 12:
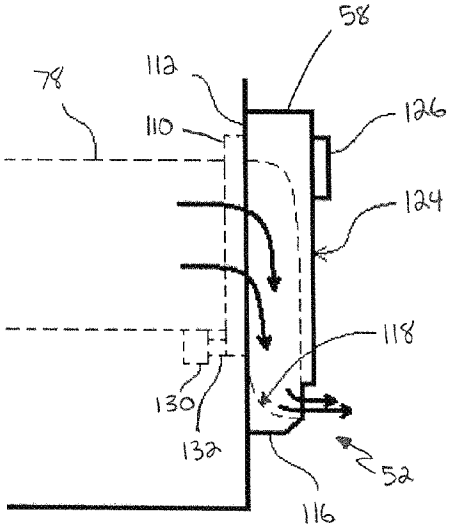
FIG. 12 is a side view of an auxiliary door for the example cooking appliance when the auxiliary door is in a first position and an air filter is attached to the auxiliary door.

Turning now to FIGS. 12-14, the auxiliary door 58 of the cooking appliance 20 will now be described in further detail. The auxiliary door 58 is configured to selectively provide access to the air duct system 54 and is movable between an open position (as shown in FIG. 13) and a closed position (as shown in FIGS. 12 and 14) such that access to the outlet plenum 78, blower 60, or other internal component is provided while the auxiliary door 58 is in the open position. For example, the auxiliary door 58 of the present embodiment is movable by pivoting the door 58 about a lower hinge. As another example, the auxiliary door 58 may be sliding door/drawer.

An air filter 110 may be provided that is slidably attached to the auxiliary door 58. When the auxiliary door 58 is in the open position, the air filter 110 can be slidably removed from the auxiliary door 58 for cleaning or replacement. When the auxiliary door 58 is in the closed position with the air filter 110 installed, the air filter 110 is arranged adjacent to the outlet plenum 78 of the air duct system 54 such that air exiting the outlet plenum 78 passes through the air filter 110 before being exhausted through the outlet 52. Moreover, the auxiliary door 58 is partially hollow and comprises one or more holes along a rear wall 112 of the auxiliary door 58 that are aligned with the air filter 110 such that the air passing through the air filter 110 then passes through the auxiliary door 58 and exits out of the outlet 52. Preferably, the air filter 110 is in abutment with the outlet plenum 78 and extends substantially completely over the hole(s) in the auxiliary door such that substantially all of the air exiting the outlet plenum 78 passes through the air filter 110 and is exhausted out of the outlet 52. A gasket made from foam, rubber, or other elastically compressible material can optionally be installed between the filter 110 and a portion of the auxiliary door 58 to promote the exhausting of air through the outlet 52 provided to the auxiliary door 58 over the escaping of the air between the filter and the auxiliary door 58.

When air exits out of the outlet 52, it is generally desired that the air not be directed towards the floor that the cooking appliance 20 rests upon. This is undesirable for a number of reasons: (1) airflow directed at the floor could cause wear on the floor surface, which can damage the floor surface; (2) airflow directed at the floor can be relatively loud; and/or (3) airflow directed at the floor may cause the airflow to backwash back towards the outlet 52 and interfere with operation of the blower 60. Thus, the auxiliary door 58 can comprise a louver 116 that is configured to direct the air out of the outlet 52 and into the ambient environment in a substantially horizontal direction that is parallel to the floor. For example, the louver 116 can comprise an interior surface 118 that is curved or otherwise arranged at an angle relative to the rear wall 112 such that air passing downward through the auxiliary door 58 is deflected off the interior surface 118 and towards the outlet 52 in a horizontal direction, or at least a forward direction, other than vertical, generally away from the cooking appliance 20. A curved geometry can provide an airflow direction transition that is relatively smooth and gradual to inhibit airflow restrictions and/or provide relatively quieter operation. In addition, one or more partition walls (not shown) may be provided within the louver 116 to separate and straighten the airflow so the air exits out of the outlet in a direction that is substantially parallel to the side surfaces 32, 34 of the cooking appliance 20.

The louver 116 can be generally hidden from a user's view to provide a "false bottom" appearance for the auxiliary door 58 and retain a cleanable and aesthetically pleasing facade for the cooking appliance 20. For example, a majority of a front surface 124 of the auxiliary door 58 can have a standard, relatively flat appearance with a handle 126 located towards a top thereof. Meanwhile, the louver 116 can be recessed from the front surface 124 so the louver 116 cannot be seen from above.

It is contemplated that the louver 116 may be integral with the remainder of the auxiliary door 58 or that the louver may be a separate element that is secured to the remaining portions. Moreover, it is to be understood that the louver 116 can direct the airflow along other various directions, such as at a non-parallel angle to the floor, and/or towards the sides the cooking appliance 20.

It may be desired to prevent operation of the blower 60 while the auxiliary door 58 is open to prevent a user from accessing the blower 60 while the blower 60 is operating. Additionally, it may be desired to prevent operation of the blower 60 when the air filter 110 is not installed. Thus, the cooking appliance 20 may comprise a second switch 130 that is configured to prevent operation of the blower 60 when the auxiliary door 58 is out of the closed position (e.g. in the open position) and/or the air filter 110 is not installed on the auxiliary door 58. The second switch 130 in the present embodiment is a plunger-type switch comprising an actuator 132 in the shape of a depressible button or pin. The second switch 130 is biased normally open and closed by pressing the actuator 132. The second switch 130 is positioned such that when the air filter 110 is installed on the auxiliary door 58, and the auxiliary door 58 is in the closed position (as shown in FIG. 12), the air filter 110 presses against the actuator 132, thus closing the second switch 130. However, if the auxiliary door 58 is open (as shown in FIG. 13), or the auxiliary door 58 is closed without the air filter 110 installed (as shown in FIG. 14), the actuator 132 will not be actuated and the second switch 130 will be open.

Like the first switch 104, the second switch 130 may be directly tied into the power supply circuit for the blower 60 such that when the second switch 130 is open, the power supply circuit is interrupted and when the second switch 130 is closed, the power supply circuit is closed. Thus, the blower 60 is prevented from operating when the auxiliary door 58 is out of the closed position and/or the air filter 110 is not installed on the auxiliary door 58. However, it should be appreciated that the second switch 130 in other embodiments can be indirectly connected, such as through an interposing relay. The second switch 130 can also provide a signal to a controller for the cooking appliance 20, which in turn controls the operation of the blower 60 based on the state of the second switch 130. Moreover, although the second switch 130 of the present embodiment is a plunger-type switch, the second switch 130 in other embodiments can be a tongue interlock that allows the head of the second switch 130 to rotate and offers different options on how to mount the second switch 130 on the blower 60 or blower housing. The second switch 130 can be any appropriate device that can interfere with operation of the blower 60 when the auxiliary door 58 is out of the closed position and/or the air filter 110 is not installed on the auxiliary door 58.

The cooking appliance 20 described above can be operated in the following manner. The use of at least one heating element 42 on the cooktop 36 may be used to actuate the blower 60. Specifically, when the heating element 42 is turned on and both the first switch 104 and the second switch 130 are closed, the blower 60 begins to operate and draws air above the cooktop 36 into the inlet 50 through the opening 92 and inlet filter 96. The air then passes through the air duct system 54, air filter 110, and the auxiliary door 58 before finally being expelled out of the outlet 52 in a horizontal direction that is parallel to the floor. The air from above the cooktop 36 is thus cleaned by the inlet filter 96 and the air filter 110 before being expelled back into the cooking appliance's ambient atmosphere. Because all of the components of the recirculating downdraft system 48 are part of the cooking appliance 20, there is no need to modify the interior area 22 in which the cooking appliance 20 is placed by, for example, adding ducting for an external downdraft system. Additionally, the system's symmetrical arrangement of plenums running along the side surfaces 32, 34 of the cooking appliance 20 provides the ability to increase the capacity of the oven cavity 44 while also maintaining an accumulated total amount of cross-sectional area for airflow around the oven cavity 44.

Figure 15:
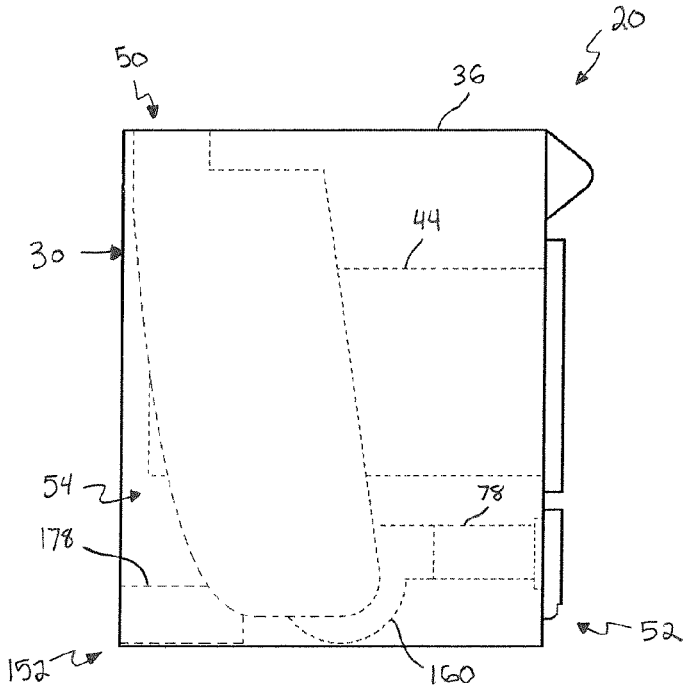
FIG. 15 is a side view of the example cooking appliance comprising an alternative blower in a first position.
Figure 16:
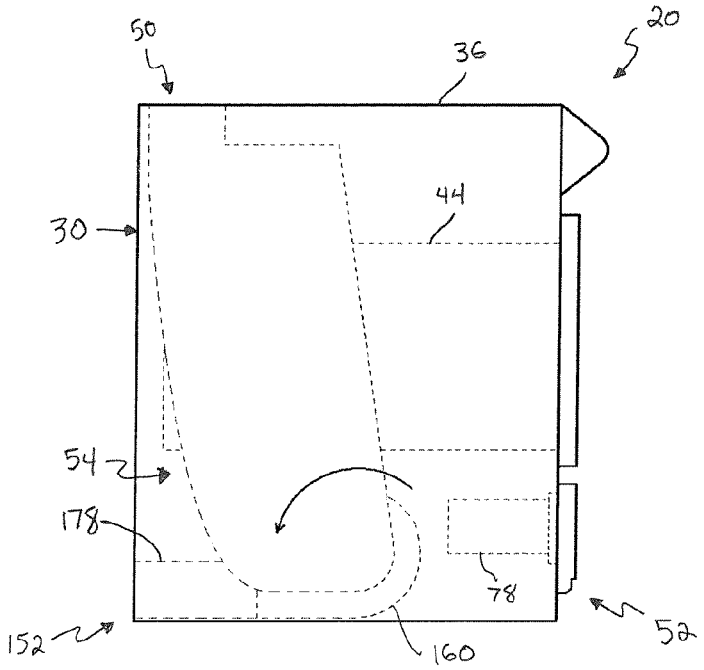
FIG. 16 is a side view of the example cooking appliance with the alternative blower in a second position.
Figure 17:
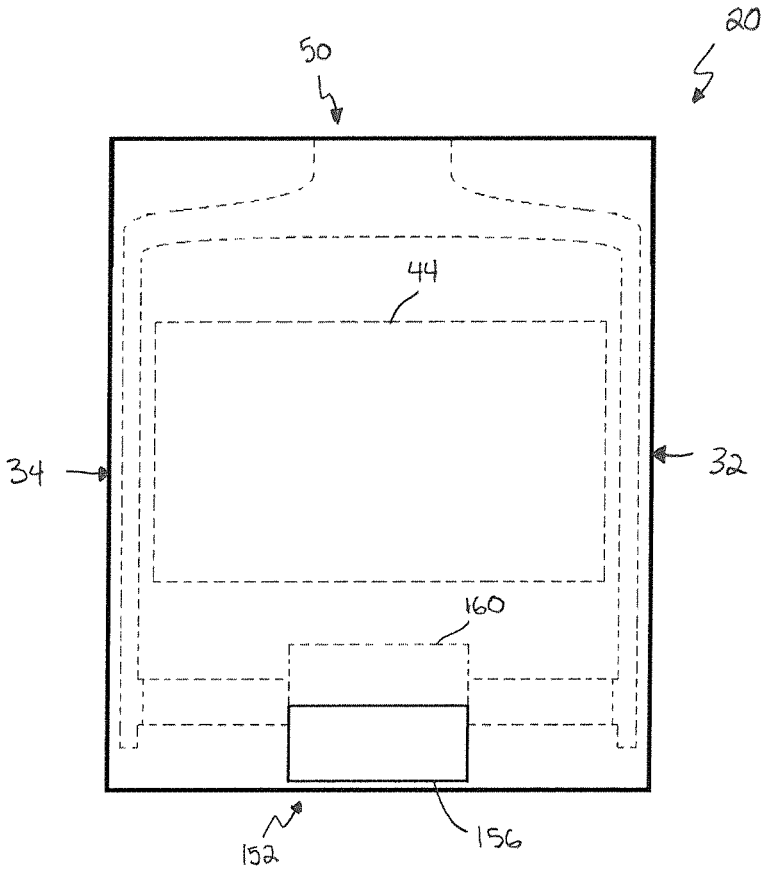
FIG. 17 is a rear view of the example cooking appliance comprising the alternative blower.

Turning to FIGS. 15-17, an embodiment of the cooking appliance 20 will now be described that comprises a second outlet 152 and second outlet plenum 178 as well as an alternative blower 160. The second outlet 152 in the present example comprises a single opening 156 defined by the back surface 30 of the cooking appliance 20. However, it should be appreciated that the second outlet 152 may comprise a plurality of apertures like the first outlet 52. Moreover, the second outlet 152 may be defined by another portion of the cooking appliance 20. For example, the second outlet 152 may be defined by the first side surface 32 or the second side surface 34. Additionally, although the second outlet 152 is positioned below the oven cavity 44, the second outlet 152 may be positioned above the oven cavity 44 in other embodiments.

The blower 160 is configured to selectively draw air from the ambient environment (e.g. interior area 22) of the cooking appliance 20 into the inlet 50 and through the air duct system 54 and expel the air out the first outlet 52 back into the ambient environment. The blower 160 is further configured to selectively draw the air from the ambient environment of the cooking appliance 20 into the inlet 50 and through the air duct system 54 and expel the air out the second outlet 152. For example, the blower 160 in the present example is movable between a first position and a second position. When the blower 160 is in the first position (as shown in FIG. 15), the blower 160 operates like the blower 60 and is configured to draw the air from the ambient environment of the cooking appliance 20 into the inlet 50 and through the air duct system 54 and expel the air out the first outlet 52 via the outlet plenum 78 back into the ambient environment. However, the blower 160 may be rotated to the second position (as shown in FIG. 16), where the blower 160 is configured to draw the air from the ambient environment of the cooking appliance 20 into the inlet 50 and through the air duct system 54 and expel the air out the second outlet 152 via the second outlet plenum 178. Thus, the air duct system 54 can selectively provide air communication between the inlet 50 and the first outlet 52 and can further selectively provide air communication between the inlet 50 and the second outlet 152. More specifically, the air duct system 54 can selectively provide a first and second air path for air to flow between the inlet 50 and the first outlet 52 and can further selectively provide a third and fourth air path for air to flow between the inlet 50 and the second outlet 152. The first air path directs air from the inlet 50 through the first inlet plenum 62 and the first side plenum 66 to the blower 160, which exhausts the air to the first outlet 52 via the outlet plenum 78. Meanwhile, the second air path directs air from the inlet 50 through the second inlet plenum 64 and the second side plenum 68 to the blower 160, which exhausts the air to the first outlet 52 via the outlet plenum 78. The third air path directs air from the inlet 50 through the first inlet plenum 62 and the first side plenum 66 to the blower 160, which exhausts the air to the second outlet 152 via the second outlet plenum 178. Meanwhile, the fourth air path directs air from the inlet 50 through the second inlet plenum 64 and the second side plenum 68 to the blower 160, which exhausts the air to the second outlet 152 via the second outlet plenum 178.

The blower 160 is a centrifugal fan in the present example. However, other types of blowers (e.g., axial) may also be used to draw odors, fumes or the like above the cooktop 36 from the inlet 50 to the outlets 52, 152 through the air duct system 54. Additionally, operation of the blower 160 may be similarly prevented/controlled utilizing the first switch 104 and the second switch 130 described above. Specifically, the first switch 104 may be configured to prevent operation of the blower 160 while the access member 82 is in the first position or any other position and/or orientation other than the second position. Moreover, the second switch 130 may be configured to prevent operation of the blower 160 when the auxiliary door 58 is out of the closed position (e.g. in the open position) and/or the air filter 110 is not installed on the auxiliary door 58.

The embodiment shown in FIGS. 15-17 can be operated in the following manner. The use of at least one heating element 42 on the cooktop 36 may be used to actuate the blower 160. Specifically, when the heating element 42 is turned on and both the first switch 104 and the second switch 130 are closed, the blower 160 begins to operate and draws air above the cooktop 36 into the inlet 50 through the opening 92 and inlet filter 96. The air then passes through the air duct system 54 and, depending on which position the blower 160 is located, is expelled out of either the first outlet 52 or the second outlet 152. Discharging air through the first outlet 52 will result in the air being recirculated into the room in which the cooking appliance 20 is located, thereby providing a recirculative downdraft operation. If a recirculative operation is not desired, however, the blower 160 can be rotated to the second position so that the air is discharged out of the second outlet 152. The second outlet 152 may feed into an external downdraft system that expels the air being discharged from the second outlet 152 through a wall of the room in which the cooking appliance 20 is located and into another room or the outdoors. Thus, the alternative blower 160 and additional outlet 152 and outlet plenum 178 provide the ability to either recirculate the air back into the ambient atmosphere of the cooking appliance 20 or expel the air to another environment.

Illustrative embodiments have been described, hereinabove. It will be apparent to those skilled in the art that various modifications and variations can be made without departing from the spirit and scope of the claimed invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cooking appliance comprising:

an oven cavity;

an oven door pivotally mounted to a front surface and configured to selectively provide access to an interior of the oven cavity a cooktop including at least one heating element and an inlet of a downdraft system, the cooktop defining a top surface of the cooking appliance;

an outlet through which air drawn into the downdraft system through the inlet is exhausted to an ambient environment of a room in which the cooking appliance is located;

an air duct system configured to provide air communication between the inlet and the outlet;

an access member pivotally mounted to the cooktop such that the access member can pivot between a first position and a second position, wherein at the first position, the access member conceals the inlet, further wherein at the second position, the access member is configured to permit air to enter the inlet, and wherein the access member comprises one of (1) a catch member configured to selectively prevent rotation of the access member beyond the second position to a third position, wherein at the third position, the access member provides access to the air duct system, (2) a cover surface that extends over the inlet at an angle relative to the top surface when the access member is in the second position, and (3) an opening that is elevated relative to the cooktop and permits the air to pass therethrough and enter the inlet when the access member is in the second position; and a blower configured to draw air from the ambient environment of the cooking appliance adjacent to the cooktop into the inlet and through the air duct system to be expelled through the outlet back into the ambient environment.

2. A cooking appliance comprising:

an oven cavity;

an oven door pivotally mounted to a front surface and configured to selectively provide access to an interior of the oven cavity a cooktop including at least one heating element and an inlet of a downdraft system, the cooktop defining a top surface of the cooking appliance;

an outlet through which air drawn into the downdraft system through the inlet is exhausted to an ambient environment of a room in which the cooking appliance is located;

an air duct system configured to provide air communication between the inlet and the outlet;

an access member pivotally mounted to the cooktop such that the access member can pivot between a first position and a second position, wherein at the first position, the access member conceals the inlet, further wherein at the second position, the access member is configured to permit air to enter the inlet;

a blower configured to draw air from the ambient environment of the cooking appliance adjacent to the cooktop into the inlet and through the air duct system to be expelled through the outlet back into the ambient environment; and a switch configured to prevent operation of the blower when the access member is not in the second position.

3. A cooking appliance comprising:

an oven cavity;

an oven door pivotally mounted to a front surface and configured to selectively provide access to an interior of the oven cavity a cooktop including at least one heating element and an inlet of a downdraft system, the cooktop defining a top surface of the cooking appliance;

an outlet through which air drawn into the downdraft system through the inlet is exhausted to an ambient environment of a room in which the cooking appliance is located;

an air duct system configured to provide air communication between the inlet and the outlet;

a blower configured to draw air from the ambient environment of the cooking appliance adjacent to the cooktop into the inlet and through the air duct system to be expelled through the outlet back into the ambient environment; and an auxiliary door that defines the outlet and is configured to selectively provide access to the air duct system, wherein the auxiliary door is movable between an open position and a closed position, and further wherein the auxiliary door comprises a louver configured to direct the air out of the outlet and into the ambient environment in a substantially horizontal direction.

4. A cooking appliance comprising:

an oven cavity an oven door pivotally mounted to a front surface and configured to selectively provide access to an interior of the oven cavity a cooktop including at least one heating element and an inlet of a downdraft system, the cooktop defining a top surface of the cooking appliance;

an outlet through which air drawn into the downdraft system through the inlet is exhausted to an ambient environment of a room in which the cooking appliance is located;

an air duct system configured to provide air communication between the inlet and the outlet;

a blower configured to draw air from the ambient environment of the cooking appliance adjacent to the cooktop into the inlet and through the air duct system to be expelled through the outlet back into the ambient environment;

an auxiliary door that defines the outlet and is configured to selectively provide access to the air duct system, wherein the auxiliary door is movable between an open position and a closed position; and an air filter removably attached to the auxiliary door and arranged such that the air passes through the air filter before exiting out of the outlet.

5. The cooking appliance of claim 4, further comprising a switch configured to prevent operation of the blower when the auxiliary door is not in the closed position and further configured to prevent operation of the blower when the air filter is removed from the auxiliary door.

6. A cooking appliance having a top surface, bottom surface, front surface, back surface, a first side surface, and a second side surface opposing the first side surface, the cooking appliance comprising:

an oven cavity;

an oven door pivotally mounted to the front surface and configured to selectively provide access to the oven cavity a cooktop including at least one heating element and an inlet, the cooktop defining the top surface of the cooking appliance;

a first outlet and a second outlet;

an air duct system configured to selectively provide air communication between the inlet and the first outlet and further configured to selectively provide air communication between the inlet and the second outlet; and a blower being movable between a first position and a second position and configured in the first position to selectively draw air from an ambient environment of the cooking appliance into the inlet and through the air duct system and expel the air out the first outlet back into the ambient environment, the blower further configured in the second position to selectively draw the air from the ambient environment of the cooking appliance into the inlet and through the air duct system and expel the air out the second outlet.

7. A cooking appliance having a top surface, bottom surface, front surface, back surface, a first side surface, and a second side surface opposing the first side surface, the cooking appliance comprising:

an oven cavity;

an oven door pivotally mounted to the front surface and configured to selectively provide access to the oven cavity a cooktop including at least one heating element and an inlet, the cooktop defining the top surface of the cooking appliance;

a first outlet and a second outlet;

an air duct system configured to selectively provide air communication between the inlet and the first outlet and further configured to selectively provide air communication between the inlet and the second outlet, wherein the air duct system is configured to selectively provide a first air path for the air to flow between the inlet and first outlet, a second air path for the air to flow between the inlet and first outlet, a third air path for the air to flow between the inlet and second outlet, and a fourth air path for the air to flow between the inlet and second outlet; and a blower configured to selectively draw air from an ambient environment of the cooking appliance into the inlet and through the air duct system and expel the air out the first outlet back into the ambient environment, the blower further configured to selectively draw the air from the ambient environment of the cooking appliance into the inlet and through the air duct system and expel the air out the second outlet.

8. The cooking appliance of claim 7, wherein the air duct system comprises a first plenum and a second plenum, wherein the first plenum extends along the first side surface in between the first side surface and the oven cavity, further wherein the second plenum extends along the second side surface in between the second side surface and the oven cavity.

* * * * *